US007318740B1

(12) United States Patent
Henry et al.

(10) Patent No.: US 7,318,740 B1
(45) Date of Patent: Jan. 15, 2008

(54) ELECTRICAL CONNECTOR HAVING A PULL TAB

(75) Inventors: Randall R. Henry, Harrisburg, PA (US); James Charles Shiffler, Hummelstown, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/500,540

(22) Filed: Aug. 8, 2006

(51) Int. Cl.
*H01R 13/627* (2006.01)

(52) U.S. Cl. ..... 439/352; 439/357

(58) Field of Classification Search ..... 439/352, 439/350, 351, 357, 358
See application file for complete search history.

(56) References Cited

U.S. PATENT DOCUMENTS 4,810,210 A * 3/1989 Komatsu ..... 439/610
4,838,808 A * 6/1989 Fujiura ..... 439/357
5,564,939 A * 10/1996 Maitani et al. ..... 439/352
5,634,809 A * 6/1997 Hirai ..... 439/352
5,951,316 A * 9/1999 Kawano et al. ..... 439/352
6,371,787 B1 4/2002 Branch et al.
6,702,603 B2 * 3/2004 Wu ..... 439/352
6,881,095 B2 4/2005 Murr et al.
7,008,253 B2 * 3/2006 Szczesny ..... 439/352
2006/0189197 A1 * 8/2006 Reed et al. ..... 439/352

* cited by examiner

*Primary Examiner*—Hien Vu

(57) ABSTRACT

An electrical connector includes a housing having a mating end, a rear end opposite the first end, and an exterior wall extending from the mating end to the rear end. The exterior wall includes a cavity extending between the mating and rear ends. A pull tab is received within the cavity. The pull tab is linearly movable within the cavity between the mating and rear ends of the housing. A latch is held on the housing and covers at least a portion of the pull tab, such that the pull tab slides between the latch and the housing. A first element on the pull tab and a second element on the latch interact to move the latch between open and closed positions in response to movement of the pull tab relative to the housing.

14 Claims, 7 Drawing Sheets

ELECTRICAL CONNECTOR HAVING A PULL TAB

BACKGROUND OF THE INVENTION

The invention relates generally to electrical connectors and, more particularly, to an electrical connector having a pull tab.

Numerous cabled electrical connectors exist that include a latch for locking the electrical connector to another electrical connector that is connected thereto. Some known latches include a hook portion that interconnects with locking features on the other electrical connector. When the electrical connectors are connected, the hook portions engage the locking features to lock the electrical connectors together. To unlock the electrical connectors, the latch may be manually operated to disengage the hook portions from the locking features. One or both of the electrical connectors can then be longitudinally moved to disconnect them from one another. To manually operate the latch, some electrical connectors include an actuating mechanism that extends from the cabled electrical connector and is pulled in a direction generally opposite the other electrical connector to disengage the hook portions. Such actuating mechanisms are sometimes referred to as pull tabs.

However, a location and/or size of the locking features that are engaged by the hook portions are sometimes standardized, whether industry-wide or between particular entities. As such, a design of the pull tabs and/or the hook portions are limited to particular configurations that conform to the standard location and/or size of the locking features. The interaction between the pull tab and the latch of some cabled electrical connectors has become overly complex. Consequently, some cabled electrical connectors are more difficult to manufacture, which adds expense, increases the potential for manufacturing error, and/or increases a time needed for manufacture thereof. Moreover, the complexity may decrease durability and/or a reliability of the pull tab. Consequently, the latch may become difficult to unlock and it may be difficult to disconnect the electrical connectors from one another. Alternatively, the latch may not properly engage the locking features of the other electrical connector such that the electrical connectors may accidentally or inadvertently disconnect from one another.

A need remains for a latch actuating mechanism for disengaging a latch of a cabled electrical connector using a pull tab that is reliable, durable, less complex, and/or that conforms to standard sizes and/or locations of locking features.

BRIEF DESCRIPTION OF THE INVENTION

In one aspect, an electrical connector is provided that includes a housing having a mating end, a rear end opposite the first end, and an exterior wall extending from the mating end to the rear end. The exterior wall includes a cavity extending between the mating and rear ends. A pull tab is received within the cavity. The pull tab is linearly movable within the cavity between the mating and rear ends of the housing. A latch is held on the housing and covers at least a portion of the pull tab, such that the pull tab slides between the latch and the housing. A first element on the pull tab and a second element on the latch interact to move the latch between open and closed positions in response to movement of the pull tab relative to the housing.

In another aspect, an electrical connector assembly including a pair of connectors configured to be electrically connected to one another is provided. The electrical connector assembly includes first and second connector housings each having a mating end. The first and second electrical connectors are configured to be electrically connected to one another adjacent the respective first and second connector housing mating ends. The first connector housing has a rear end opposite the mating end and an exterior wall extending from the mating end to the rear end. The exterior wall includes a cavity extending between the mating and rear ends of the first connector housing. A pull tab is received within the cavity. The pull tab is linearly movable within the cavity between the mating and rear ends of the first connector housing. A latch is held on the first connector housing. At least a portion of the pull tab is between the latch and the first connector housing. A first element on the pull tab and a second element on the latch interact to cause the latch to move between an open and a closed position upon movement of the pull tab within the cavity.

DETAILED DESCRIPTION OF THE INVENTION

Figure 1:
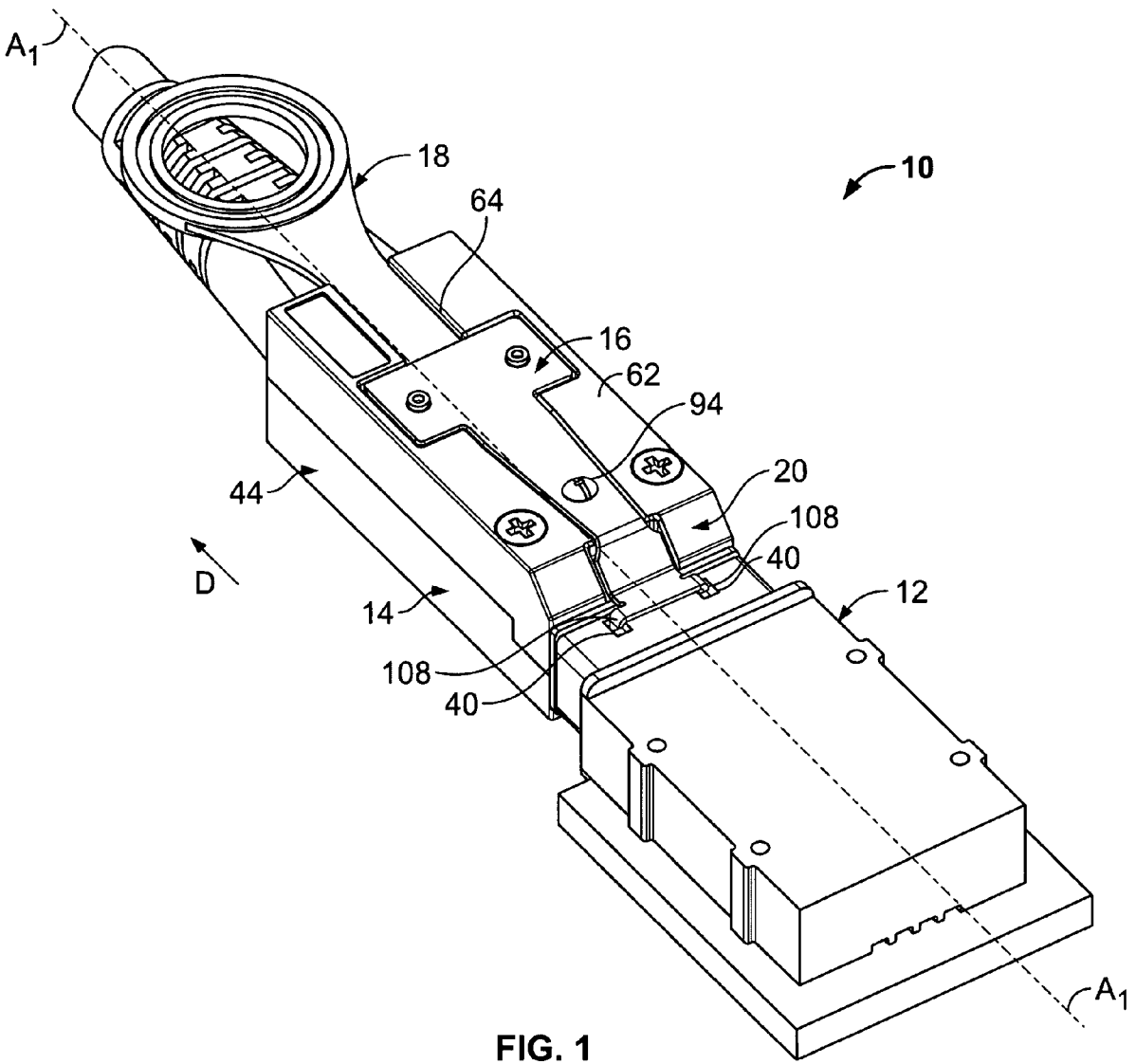
FIG. 1 is a perspective view of an electrical connector assembly formed in accordance with an embodiment of the present invention.

FIG. 1 is a perspective view of an electrical connector assembly 10 formed in accordance with an embodiment of the present invention. The connector assembly 10 includes a receptacle connector 12 and a plug connector 14 that are configured to be electrically connected to one another. The connector assembly 10 includes a longitudinal axis $A_1$ that extends through the connectors 12 and 14. As will be described in more detail below, the plug connector 14 includes a latch 16 for locking the connectors 12 and 14 together when they are connected, and a pull tab 18 for actuating the latch 16 between a closed position 20 where the connectors 12 and 14 are locked together and an open position 22 (FIG. 9) where the connectors 12 and 14 are unlocked. Although the receptacle connector 12 is described and illustrated herein as a receptacle connector that receives a portion of the plug connector 14 therein, the plug connector 14 may alternatively be a receptacle connector that receives a portion of the connector 12 therein. Moreover, although the plug connector 14 is described and illustrated herein as including the latch 16 and the pull tab 18, in addition or alternatively, the receptacle connector 12 may include the latch 16 and the pull tab 18.

Figure 2:
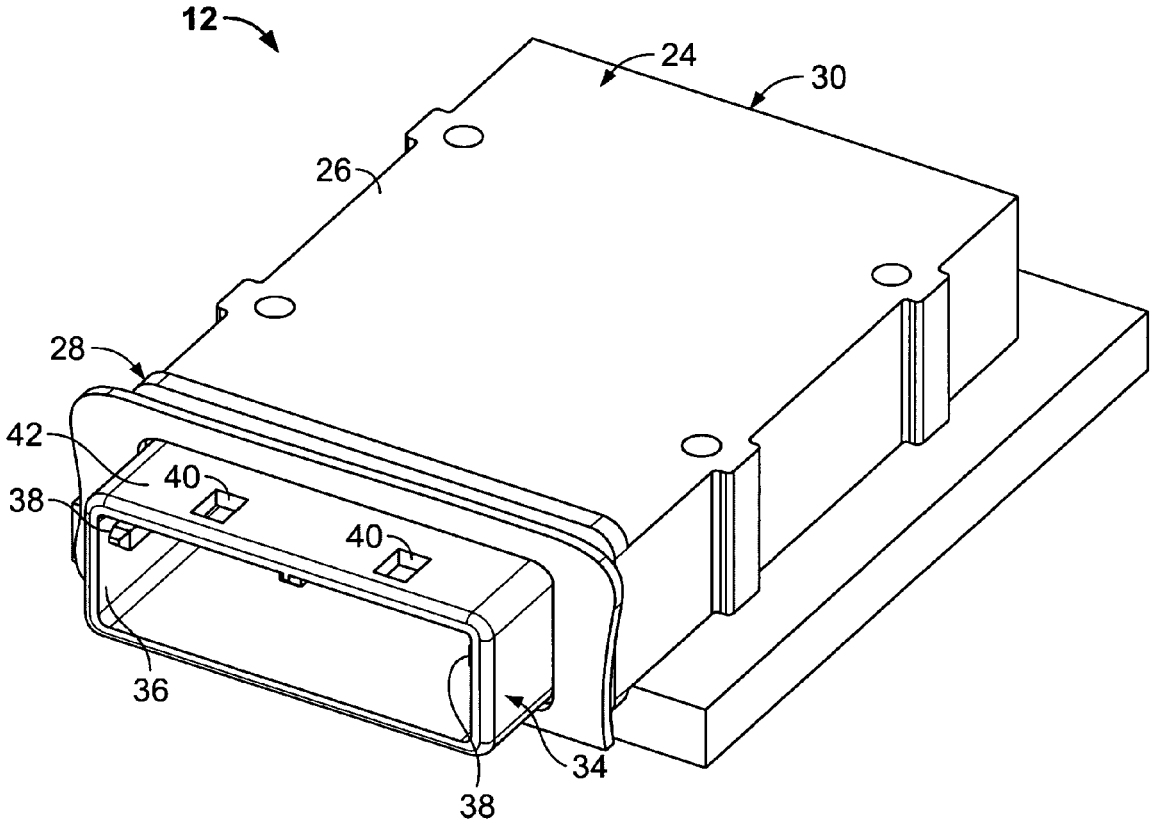
FIG. 2 is a front perspective view of the receptacle connector shown in FIG. 1.

FIG. 2 is a front perspective view of the receptacle connector 12. The receptacle connector 12 includes a housing 24 having a body 26 extending between a mating end 28 and an end 30 opposite the mating end 28. The housing body 26 defines a cavity (not shown) within the housing 24. One or more interface components (not shown), such as, but not limited to a printed circuit board, of the receptacle connector 12 is held within the housing cavity for interfacing with one or more interface components, such as, but not limited to, a printed circuit board 32 (FIGS. 3 and 4), of the plug connector 14. An interface structure 34 is held at least partially within the housing cavity and extends outward from the housing cavity through the housing mating end 28. The interface structure 34 includes an opening 36 for receiving the printed circuit board 32 of the plug connector 14. One or more guides 38 may be held within the housing cavity and/or the interface structure opening 36 to facilitate alignment of the interface component(s) of the receptacle connector 12 with the printed circuit board 32. Although the housing 24 is shown as having a generally rectangular box shape, the housing 24 may have any shape.

The interface structure 34 also includes one or more openings 40 that interlock with the latch 16 of the plug connector 14 to lock the connectors 12 and 14 together, as will be described in more detail below. Although the openings 40 are shown as extending completely through a wall 42 of the interface structure 34, the openings 40 may extend only partially though the wall 42. Moreover, although two openings 40 are shown, the interface structure 34 may include any number of openings 40. In addition or alternative to the openings 40, the interface structure 34 may include one or more extensions (not shown) that extend outwardly from the interface structure 34 for interlocking with the latch 16 of the plug connector 14. As shown herein, the receptacle connector 12 is a serial attached SCSI (SAS) electrical connector. However, the receptacle connector 12 may be any type of electrical connector.

Figure 3:
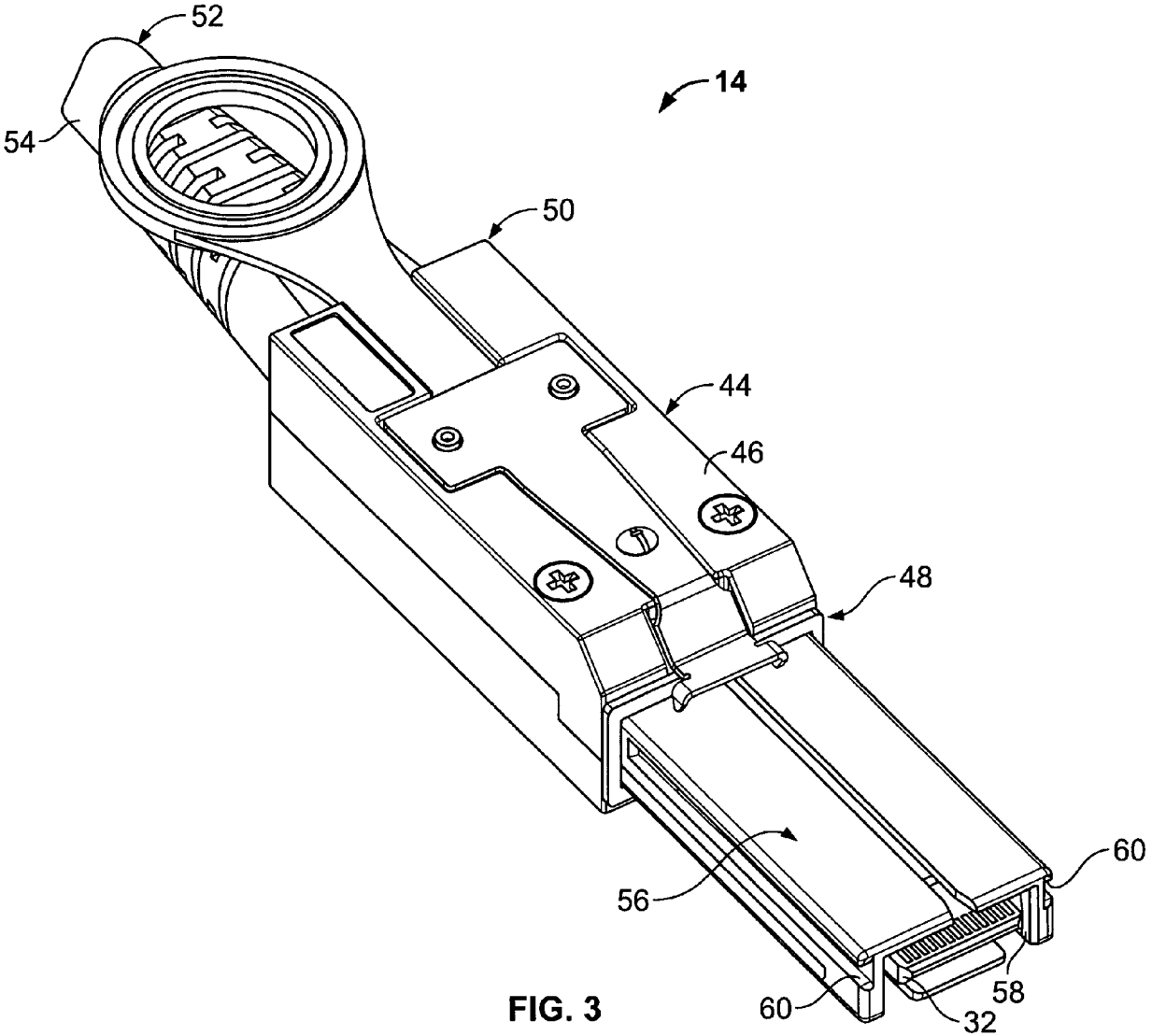
FIG. 3 is a front perspective view of the plug connector shown in FIG. 1.

FIG. 3 is a front perspective view of the plug connector 14. The plug connector 14 includes a housing 44 having a body 46 extending between a mating end 48 and a rear end 50 opposite the mating end 48. The housing body 46 defines a cavity (not shown) within the housing 44. A portion of the printed circuit board 32 is held within the housing cavity. A cable 52 is coupled to the housing rear end 50. The cable 52 includes an insulating cover 54 that covers a plurality of cable wires (not shown). The cable wires extend at least partially into the housing cavity and are electrically connected to the printed circuit board 32. An interface structure 56 is held at least partially within the housing cavity and extends outwardly from the housing cavity through the housing mating end 48. The printed circuit board 32 extends outwardly from the housing cavity through the housing mating end 48 and within an opening 58 within the interface structure 56. When the connectors 12 and 14 are connected together, the interface structure 56 and the printed circuit board 32 are at least partially received within the interface structure opening 36 and the housing cavity of the receptacle connector 12 such that the printed circuit board 32 interfaces with the interface component(s) of the receptacle connector 12.

The interface structure 56 may include one or more guide slots 60 that each receive one of the guides 38 (FIG. 2) held within the housing cavity of the receptacle connector 12 to facilitate alignment of the interface component of the receptacle connector 12 with the printed circuit board 32 of the plug connector 14. Although the housing 44 is shown as having a generally rectangular box shape, the housing 44 may have any shape. Although the plug connector 14 electrically connects the cable 52 to the receptacle connector 12, alternatively the plug connector 14 is not connected to the cable 52 but rather is another type of electrical connector. As shown herein, the plug connector 14 is an external serial attached SCSI (SAS) electrical connector. However, the plug connector 14 may be any type of electrical connector.

Figure 4:
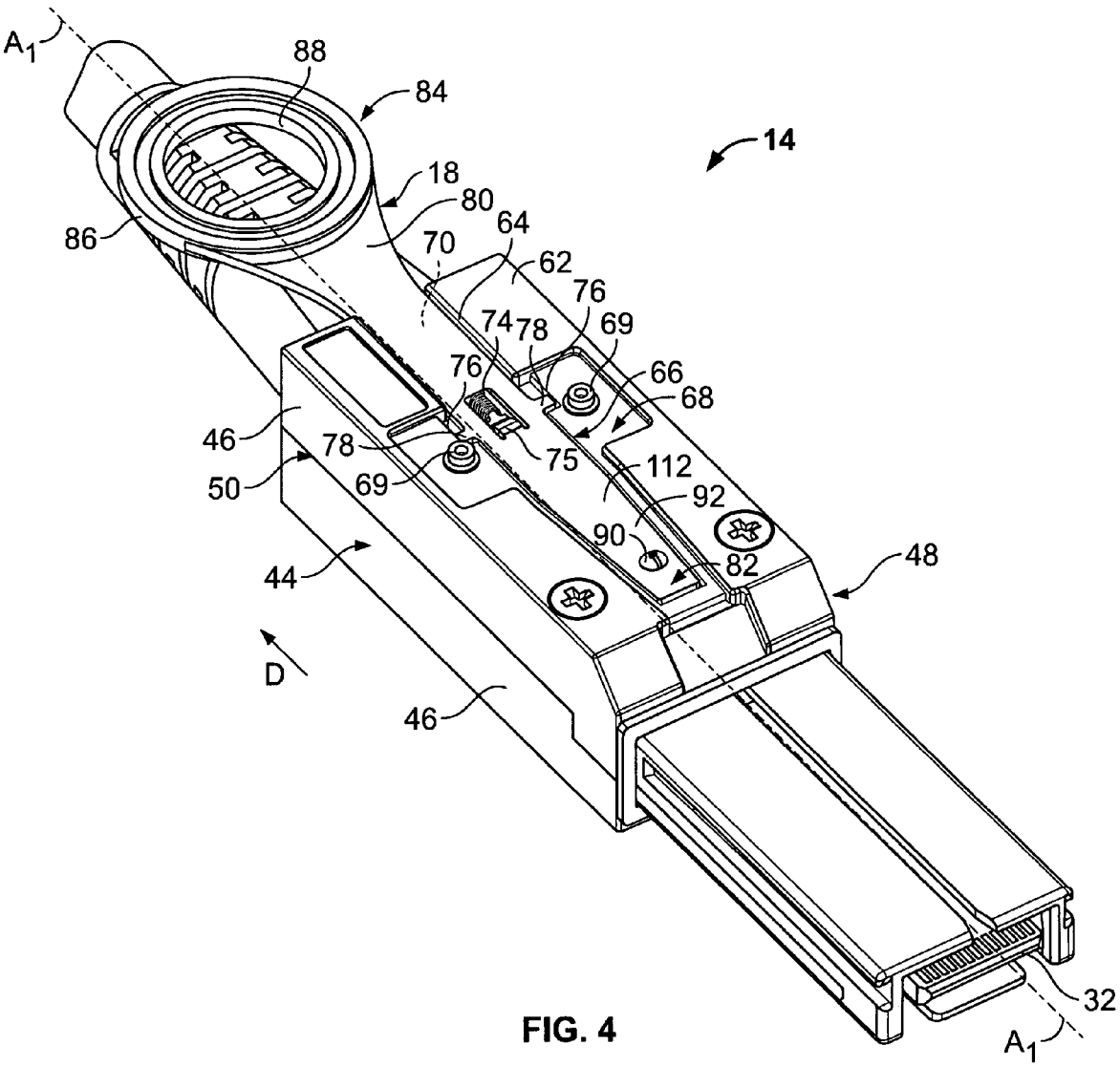
FIG. 4 is a front perspective view of the plug connector shown in FIG. 3 with a pull tab exposed.

FIG. 4 is a front perspective view of the plug connector 14 with the pull tab 18 exposed. The housing body 46 includes an exterior wall 62 that extends from the mating end 48 to the rear end 50 of the housing 44. The exterior wall 62 includes a cavity 64 extending between the mating end 48 and the rear end 50 of the housing 44. Although the housing cavity 64 is shown as extending from the mating end 48 to the rear end 50, alternatively the housing cavity 64 may extend only partially between the mating end 48 and the rear end 50 of the housing 44, may extend only partially from the mating end 48 to the rear end 50, or may extend only partially from the rear end 50 to the mating end 48. The housing cavity 64 includes a bottommost portion 66 that is sized and shaped to receive the pull tab 18 such that the pull tab 18 is linearly movable therein, as will be described in more detail below. An uppermost portion 68 of the housing cavity 64 is sized and shaped to receive the latch 16 (FIGS. 1, 6, and 9), as will also be described in more detail below. The uppermost portion 68 of the housing cavity 64 may include one or more alignment elements 69 for aligning the latch 16 within the housing cavity 64 using corresponding openings 106 (FIG. 6) within the latch 16.

Bias may be applied to the pull tab 18 within the bottommost portion 66 of the housing cavity 64. The bias may be applied using any suitable structure and/or means having any suitable configuration, arrangement, orientation, position, and/or location. For example, a surface 70 of the exterior wall 62 that defines the bottommost portion 66 of the housing cavity 64 may include an opening (not shown) that receives a biasing mechanism, such as, but not limited to, a helical spring 74 or other type of spring. The opening is positioned such that the spring 74 is held between the housing exterior wall 62 and the pull tab 18 when the pull tab 18 is received within the housing cavity 64. The spring 74 contacts and applies bias to an extension 75 of the pull tab 18 that extends outwardly from the pull tab 18 at least partially into the opening, such that the spring 74 applies bias to pull tab 18 as described below. Alternatively, bias is not applied to the pull tab 18 within the housing cavity 64 and therefore the extension 75, the opening, the spring 74, another biasing mechanism, and/or other structure and/or means for applying bias to the pull tab 18 within the housing cavity 64 may not be included.

The housing 44 may include one or more travel limits that cooperate with one or more travel limits on the pull tab 18 to define a range of motion over which the pull tab 18 moves within the cavity 64. The travel limits of the housing 44 may have any suitable configuration, arrangement, orientation, position, and/or location, and/or may include any structure and/or means, that enable the travel limits to function as described herein. For example, the travel limits of the housing 44 may be a pair of opposing slots 76 that communicate with the bottommost portion 66 of the housing cavity. Each slot 76 is sized and shaped to receive an extension 78 that extends outwardly from the pull tab 18 and is movable within the slot 76 to define the range of motion of the pull tab 18, as described below. Although two slots 76 are shown, the housing 44 may include any number of slots 76 that function as travel limits.

Figure 5:
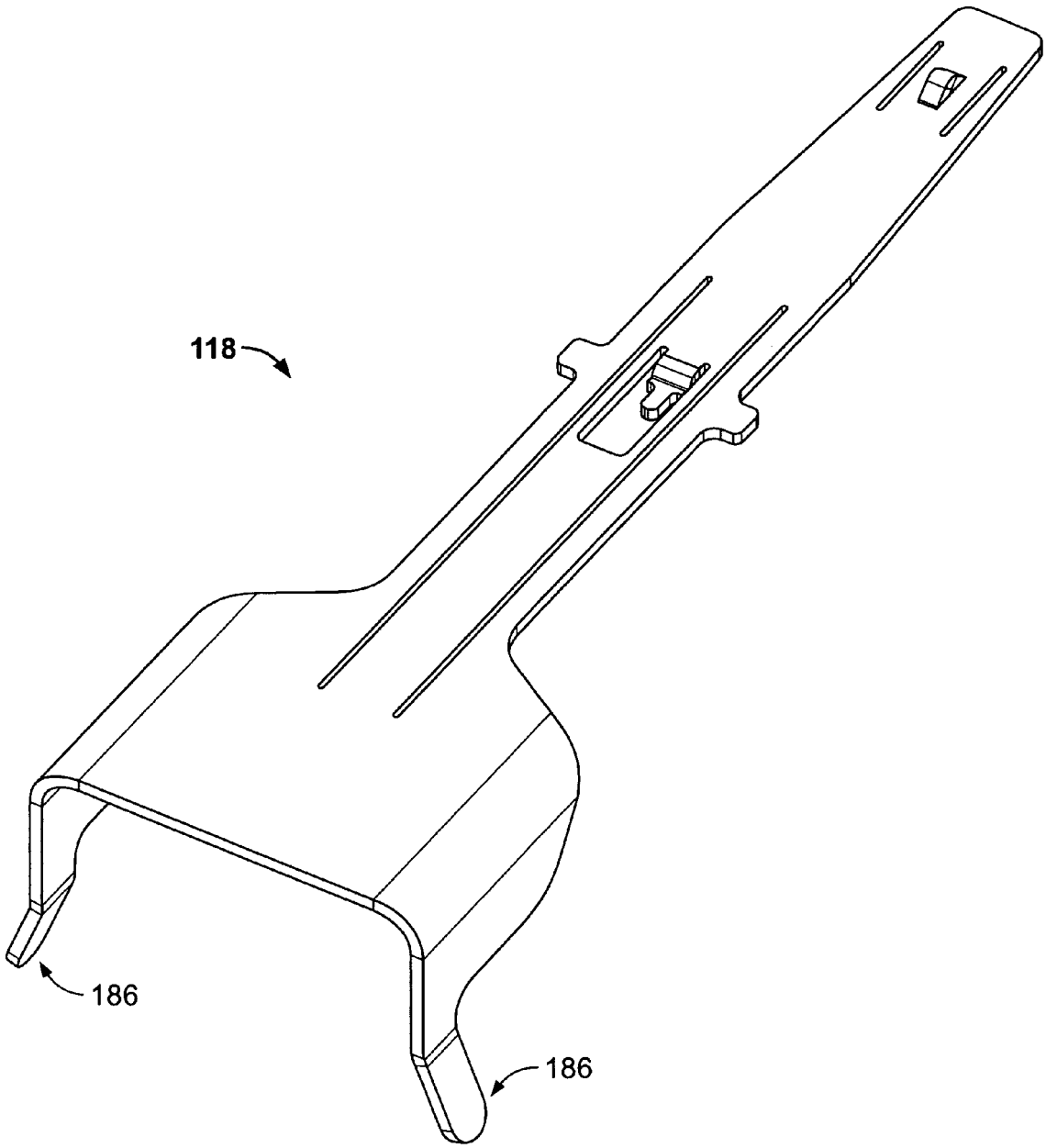
FIG. 5 is a rear perspective view of a pull tab formed in accordance with an alternative embodiment of the present invention.

The pull tab 18 is received within the bottommost portion 66 of the housing cavity 64 and is linearly movable therein along the longitudinal axis $A_1$ between the mating and rear ends 48 and 50, respectively, of the housing 44. The pull tab 18 includes a body 80 that extends from an end 82 to an opposite end 84. The end 84 may include a handle 86 for moving the pull tab 18 along the longitudinal axis $A_1$, for example pulling the pull tab 18 along the longitudinal axis $A_1$ in the direction D. Although the handle 86 is shown as having a generally circular opening 88 adjacent the pull tab end 84 for gripping the pull tab 18 using one or more fingers of a user, the handle 86 may have any suitable configuration, arrangement, location, orientation, and/or position, and/or may include any suitable structure and/or means, that enable the handle 86 to function as described herein. For example, FIG. 5 is a perspective view of a pull tab 118 formed in accordance with an alternative embodiment of the present invention, wherein the pull tab 118 includes a handle 186 having a different shape than the handle 86. Alternatively, the pull tab does not include a handle. The pull tab body 80 may have any suitable size and/or shape that enables the pull tab 18 to function as described herein.

The pull tab 18 includes one or more elements that interact with one or more elements on the latch 16 to cause the latch 16 to move between the open and closed positions 22 and 20, respectively, (FIGS. 9 and 1, respectively) upon movement of the pull tab 18 within the housing cavity 64. The element(s) of the pull tab 18 that interact with the latch element(s) may have any suitable configuration, arrangement, orientation, position, and/or location. For example, as shown in FIG. 4 the pull tab element(s) may be an extension 90 that extends outwardly from a surface 92 of the pull tab 18 adjacent the end 82. When the latch 16 is received within the housing cavity 64, the extension 90 extends between the pull tab 18 and the latch 16 and interacts with an indentation 94 (FIGS. 1 and 6) on the latch 16, as described below. The extension 90 may have any suitable size, shape, location, orientation, and/or position that enables the extension 90 to function as described herein. Although one extension 90 is shown, the pull tab 18 may include any number of extensions 90 that interact with any number of indentations 94 on the latch 16. Alternatively, the pull tab element(s) may be an indentation (not shown) that interacts with an extension 98 (FIG. 7) extending outwardly from an alternative embodiment of a latch 116. The indentation is sized, shaped, located, orientated, and positioned to at least partially receive the extension 98. The pull tab 18 may include any number of indentations that interact with any number of extensions 98 on the latch 116.

The travel limits on the pull tab 18 may have any suitable configuration, arrangement, orientation, position, and/or location, and/or may include any structure and/or means, that enable the travel limits to function as described herein. For example, the travel limits on the pull tab 18 may be a pair of the extensions 78 that extend outwardly from the pull tab 18 and are received within a corresponding slot 76 when the pull tab 18 is received within housing cavity 64. The extensions 78 are movable within the slots 76 to define the range of motion of the pull tab 18, as described below. Although two extensions 78 are shown, the pull tab 18 may include any number of extensions 78 that function as travel limits. The extensions 78 may have any suitable size and/or shape that enable the extensions 78 to function as described herein.

Figure 6:
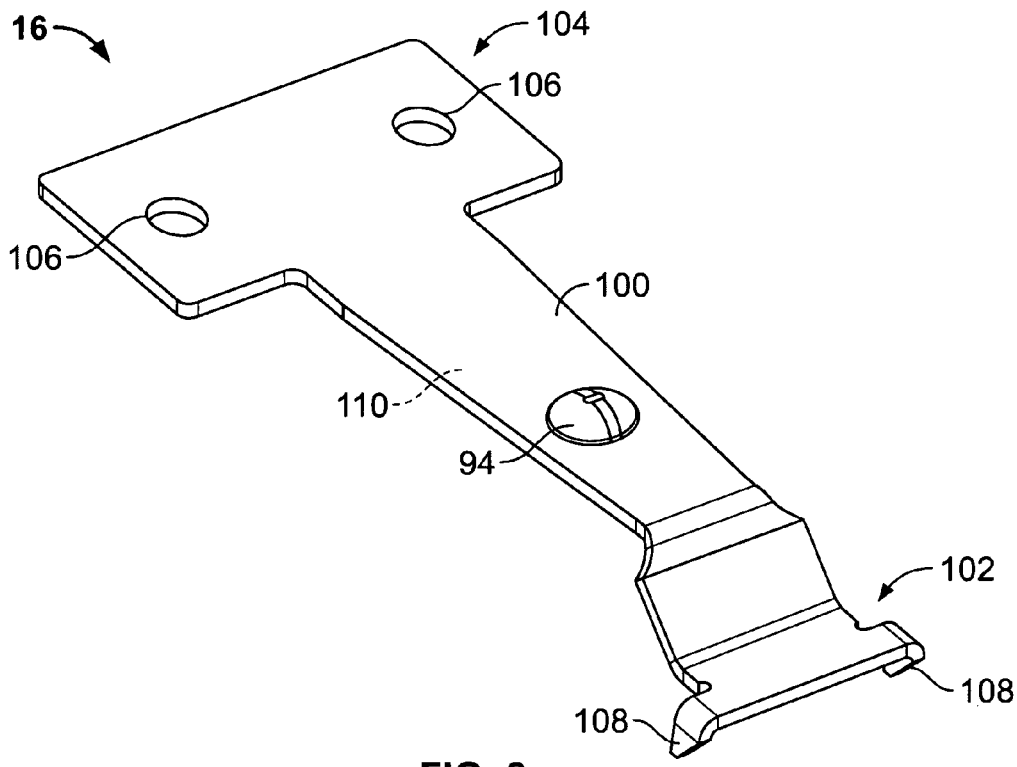
FIG. 6 is a front perspective view of a latch formed in accordance with an embodiment of the present invention.
Figure 9:
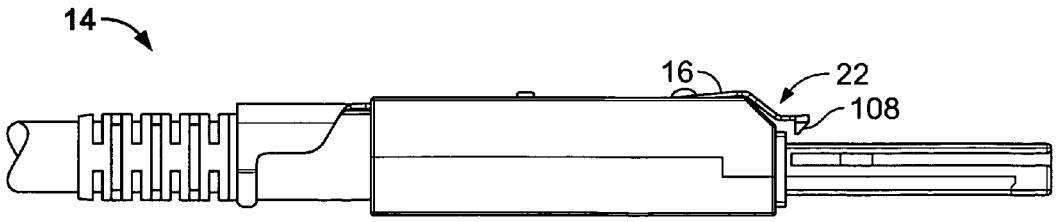
FIG. 9 is a side elevational view of the plug connector shown in FIG. 3 with a latch in an open position.

FIG. 6 is a front perspective view of the latch 16 formed in accordance with an embodiment of the present invention. The latch 16 includes a body 100 extending from an end 102 and an end 104 that is opposite the end 102. A portion of the latch 16 is received within the uppermost portion 68 (FIG. 4) of the housing cavity 64 (FIGS. 1 and 4), as shown in FIGS. 1, 3, and 9. The latch 16 may be aligned within the housing cavity 64 by receiving the alignment elements 69 (FIG. 4) of the housing 44 (FIGS. 1, 3, and 4) within each of the corresponding openings 106 within the latch body 100. The latch 16 is fixedly held on the housing 44 such that a portion of the pull tab 18 (FIGS. 1 and 4) is between the latch 16 and the housing exterior wall 62 (FIG. 4), as shown in FIGS. 1 and 3. The latch 16 may be fixedly held on the housing 44 using any suitable structure and/or means that enable the latch 16 to function as described herein. Generally, the latch 116 is fixedly held on the housing 44 such that the latch 16 is in the closed position 20 (FIG. 1). The latch body 100 may have any suitable size and/or shape that enables the latch 16 to function as described herein.

The latch 16 includes a pair of extensions 108 extending outwardly from the latch body 100 adjacent the end 102. The extensions 108 each interlock with a corresponding opening 40 (FIG. 2) within the interface structure 34 (FIG. 2) of the receptacle connector 12 (FIGS. 1 and 2) to lock the connectors 12 and 14 together. More specifically, each extension 108 is at least partially received within a corresponding opening 40 when the latch 16 is in the closed position 20 (FIG. 1), as will be described in more detail below. The extensions 108 may each have any suitable size, shape, position, orientation, and/or location to function as described herein, for example to be at least partially received within a corresponding opening 40. Although two extensions 108 are shown, the latch 16 may include any number of extensions 108. In addition or alternative to the extensions 108, the latch 16 may include one or more openings (not shown) for interlocking with one or more extensions (not shown) that extend outwardly from the interface structure 34 of the connector 12.

Figure 7:
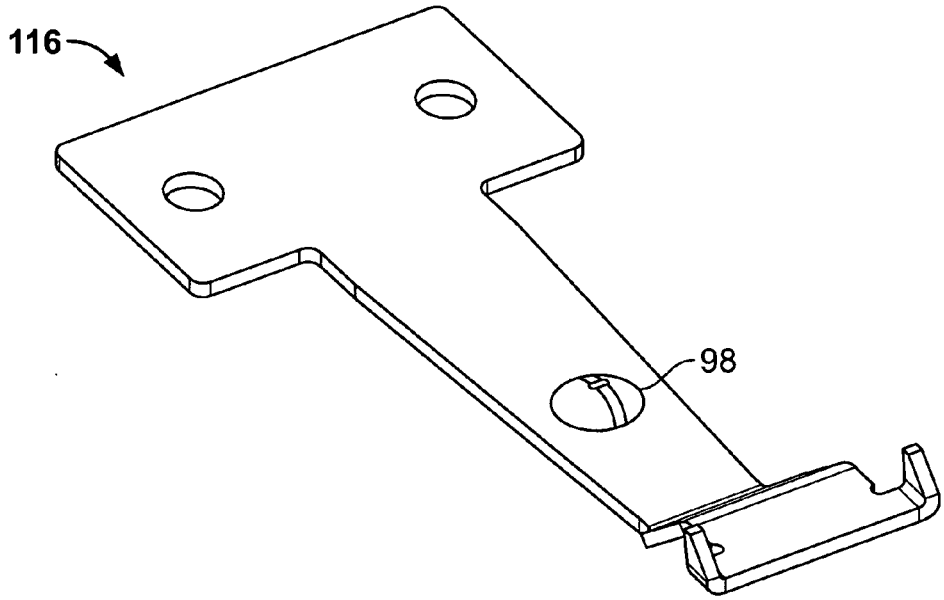
FIG. 7 is a front perspective view of a latch formed in accordance with an alternative embodiment of the present invention.

The element(s) of the latch 16 that interact with the pull tab element(s) to cause the latch 16 to move between the open and closed positions 22 and 20, respectively, may have any suitable configuration, arrangement, orientation, position, and/or location. For example, as shown in FIG. 6 the latch element(s) may be the indentation 94 that interacts with the extension 90 (FIG. 4) of the pull tab 18. The indentation 94 is sized, shaped, located, positioned, and orientated to at least partially receive the extension 90. Although one indentation 94 is shown, the latch 16 may include any number of indentations 94 that interact with any number of extensions 90 on the pull tab 18. Alternatively, as shown in FIG. 7 the latch element(s) of an alternative embodiment of a latch 116 may be the extension 98 that interacts with an indentation within the pull tab 18, as described above. The extension 98 may have any suitable size, shape, location, position, and orientation that enables the extension 98 to function as described herein. Although one extension 98 is shown, the latch 116 may include any number of extensions 98 that interact with any number of indentations on the pull tab 18.

Figure 8:
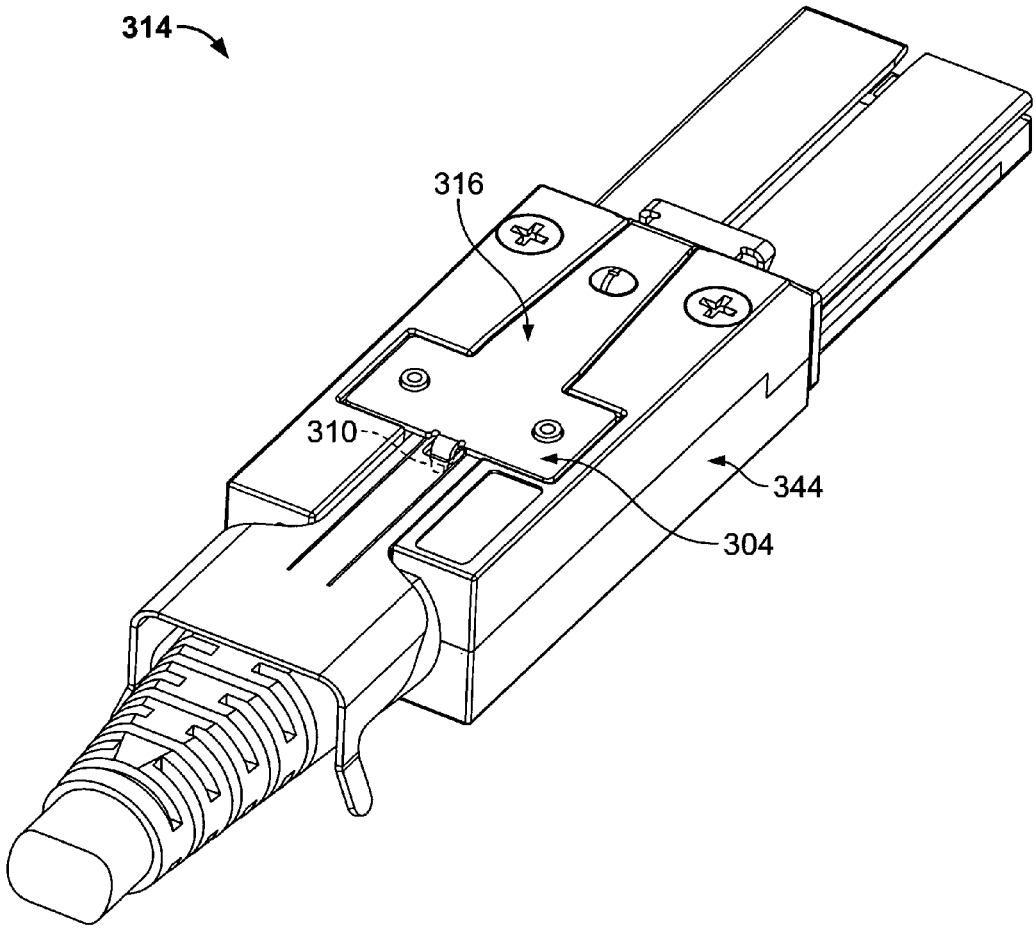
FIG. 8 is a rear perspective view of a plug connector formed in accordance with an alternative embodiment of the present invention.

The latch 16 may be biased to the closed position 20 using a biasing mechanism that is not part of the latch body 100 (i.e., using bias other than the natural bias of the latch body 100 to generally retain its shape). The bias may be applied using any suitable structure and/or means having any suitable configuration, arrangement, orientation, position, and/or location. For example, FIG. 8 is a perspective view of an alternative embodiment of a connector 314 wherein a biasing mechanism, such as, but not limited to, a spring 310 or other type of biasing mechanism is held in a housing 344 of the connector 314 for applying bias to an end 304 of a latch 316 to bias the latch 316 to a closed position. Alternatively, bias additional to the natural bias of the latch body 100 is not applied to the latch 16 using a biasing mechanism that is not part of the latch body 100.

In operation, and referring to FIG. 1, the pull tab 18 can be moved within the housing cavity 64 along the longitudinal axis $A_1$. When the pull tab 18 is in a position relative to the latch 16 such that the pull tab extension 90 (FIG. 4) is received within the indentation 94 of the latch 16, the latch 16 is in the closed position 20 wherein the latch extensions 108 are received within the corresponding openings 40 of the receptacle connector 12 and the connectors 12 and 14 are thereby locked together. When the pull tab 18 is moved along the longitudinal axis $A_1$ in the direction D, the pull tab extension 90 moves out of the latch indentation 94 and contacts a surface 110 (FIG. 6) of the latch 16 that is normally adjacent a surface 112 (FIG. 4) of the pull tab 18. As the extension 90 moves along the latch surface 110, the extension 90 moves the latch 16 from the closed position 20 to the open position 22 shown in FIG. 9. More specifically, as the extension 90 moves along the latch surface 110, the extension 90 deflects the end 102 of the latch 16, against the natural bias of the latch body 100 to generally retain its shape, such that the latch extensions 108 move out of the openings 40 of the connector 12 to unlock the connectors 12 and 14 from one another. Once unlocked, the connectors 12 and 14 can be disconnected from one another. Operation of the reverse arrangement of an indentation on the pull tab 18 and the extension 98 (FIG. 7) will function in a similar manner, and therefore will not be described in more detail herein.

As discussed above, the spring 74 (FIG. 4) may be included to apply bias to the extension 75 (FIG. 4) of the pull tab 18 such that the pull tab 18 is biased to a position relative to the latch 16 wherein the latch 16 is in the closed position 20. More specifically, the spring 74 biases the pull tab 18 to a position wherein the pull tab extension 90 is received within the latch indentation 94. Alternatively, the pull tab 18 is not biased, or the bias is applied using other suitable structure and/or means having any suitable configuration, arrangement, orientation, position, and/or location.

As discussed above, the pull tab extensions 78 (FIG. 4) are movable within the slots 76 (FIG. 4) to define the range of motion of the pull tab 18. More specifically, the slots 76 may limit movement of the pull tab along the longitudinal axis $A_1$ to a predetermined range of motion within the housing cavity 64, depending upon a length of the slots 76 and a width of the extensions 78. The predetermined range of motion may facilitate, for example, preventing the pull tab 18 from imparting an amount of deflection that may damage the latch 16.

Although the pull tab 18 and the latch 16 are described and illustrated herein as being positioned and located on the exterior wall 62 of the housing 44, the pull tab 18 and the latch 16 may have any other suitable position and location on the plug connector 14 that enables the pull tab 18 and the latch 16 to function as described herein.

The embodiments described herein provide a connector that may be locked together with another connector. A pull tab is provided for actuating a latch that locks the connectors together. The pull tab and latch may be more reliable, durable, and/or less complex than similar known connectors. The use of the same connector may conform to standard sizes and/or locations of locking features on the other connector.

While the invention has been described in terms of various specific embodiments, those skilled in the art will recognize that the invention can be practiced with modification within the spirit and scope of the claims.

What is claimed is:

1. An electrical connector comprising:

a housing having a mating end, a rear end opposite the mating end, and an exterior wall extending from the mating end to the rear end, the exterior wall including a cavity extending between the mating and rear ends;

a pull tab received within the cavity, the pull tab being linearly movable within the cavity between the mating and rear ends of the housing;

a latch held on the housing and covering at least a portion of the pull tab, such that the pull tab slides between the latch and the housing;

a first element on the pull tab and a second element on the latch that interact to move the latch between open and closed positions in response to movement of the pull tab relative to the housing; and a biasing mechanism being a helical spring attached to at least a portion of the pull tab and held between the housing and the at least a portion of the pull tab, the biasing mechanism biasing the pull tab to a position relative to the latch wherein the latch is in the closed position; wherein the first element comprises an extension extending outwardly from the pull tab and the second element comprises an indentation within the latch for receiving the extension therein.

2. The connector of claim 1 further comprising travel limits provided on the pull tab and within the housing cavity, the travel limits cooperating with one another to define a range of motion over which the pull tab moves within the housing cavity.

3. The connector of claim 1 further comprising an extension extending outwardly from the pull tab and a slot provided within the housing and communicating with the housing cavity, the extension being received within the slot and being movable within the slot to define a range of motion over which the pull tab moves within the housing cavity.

4. The connector of claim 1, wherein the connector is a first connector and wherein the latch comprises a body extending from a first end to an opposite second end, the latch body first end comprising an extension configured to be received within an opening within a second connector to lock the first and second connectors together.

5. The connector of claim 1, wherein the rear end of the housing comprises an opening configured to receive an electrical cable.

6. The connector of claim 1, wherein the latch is received within a portion of the housing cavity.

7. The connector of claim 1, wherein the connector is an external serial attached small computer system interface (SCSI) connector.

8. An electrical connector assembly including a pair of connectors configured to be electrically connected to one another, the electrical connector assembly comprising:

first and second connector housings each having a mating end, the first and second connectors configured to be electrically connected to one another adjacent the respective first and second connector housing mating ends, the first connector housing having a rear end opposite the mating end and an exterior wall extending from the mating end to the rear end, the exterior wall including a cavity extending between the mating and rear ends of the first connector housing;

a pull tab received within the cavity, the pull tab being linearly movable within the cavity between the mating and rear ends of the first connector housing;

a latch held on the first connector housing, at least a portion of the pull tab between the latch and the first connector housing;

a first element on the pull tab and a second element on the latch that interact to cause the latch to move between an open and a closed position upon movement of the pull tab within the cavity; and a biasing mechanism being a helical spring attached to at least a portion of the pull tab and held between the first connector housing and the at least a portion of the pull tab, the biasing mechanism biasing the pull tab to a position relative to the latch wherein the latch is in the closed position; wherein the first element comprises an extension extending outwardly from the pull tab and the second element comprises an indentation within the latch for receiving the extension therein.

9. The assembly of claim 8 further comprising travel limits provided on the pull tab and within the first connector housing cavity, the travel limits cooperating with one another to define a range of motion over which the pull tab moves within the first connector housing cavity.

10. The assembly of claim 8 further comprising an extension extending outwardly from the pull tab and a slot provided within the first connector housing and communicating with the first connector housing cavity, the extension being received within the slot and being movable within the slot to define a range of motion over which the pull tab moves within the first connector housing cavity.

11. The assembly of claim 8, wherein the latch comprises a body extending from a first end to a second end, the latch body first end being adjacent the mating end of the first connector housing, the latch body first end comprising an extension configured to be received within an opening within the second connector to lock the first and second connectors together.

12. The assembly of claim 8, wherein the mating end of the first connector housing comprises an opening configured to receive an electrical cable.

13. The assembly of claim 8, wherein the latch is received within a portion of the first connector housing cavity.

14. The assembly of claim 8, wherein the first connector is an external serial attached small computer system interface (SCSI) connector.

* * * * *